US006948742B2

(12) United States Patent
Buck

(10) Patent No.: US 6,948,742 B2
(45) **Date of Patent: *Sep. 27, 2005**

(54) PROMOTIONAL FORM WITH DETACHABLE ELEMENT

(75) Inventor: Roger Buck, Pittsburg, KS (US)

(73) Assignee: Ward-Kraft, Inc., Fort Scott, KS (US)

( * ) Notice: Subject to any disclaimer, the term of this patent is extended or adjusted under 35 U.S.C. 154(b) by 298 days.

This patent is subject to a terminal disclaimer.

(21) Appl. No.: 10/154,761

(22) Filed: May 24, 2002

(65) Prior Publication Data

US 2003/0218329 A1 Nov. 27, 2003

(51) Int. Cl.[7] ..... B65D 27/04; B65D 27/06; B65D 27/34

(52) U.S. Cl. ..... 283/56; 283/98; 283/101; 283/105; 283/106; 283/61; 229/70; 229/71; 229/72; 229/92; 229/92.1; 229/92.8; 229/300; 229/303; 493/405; 493/413; 428/41.7; 428/41.8; 428/41.9; 40/341; 462/8; 462/18; 462/25; 462/26; 462/900

(58) Field of Search ..... 229/70, 71, 72, 229/92, 92.1, 92.8, 300, 303; 283/98, 101, 106, 56, 109, 105; 493/405, 413; 428/41.7, 41.8, 41.9, 42.3; 40/341; 462/8, 18, 25, 26, 900

(56) References Cited

U.S. PATENT DOCUMENTS 3,900,219 A 8/1975 D'Amato et al.
3,956,049 A 5/1976 Johnsen
4,039,122 A 8/1977 Johnsen (Continued)

FOREIGN PATENT DOCUMENTS

JP 402277698 A * 11/1990

*Primary Examiner*—Derris Banks
*Assistant Examiner*—Mark Henderson
(74) *Attorney, Agent, or Firm*—Hovey Williams LLP

(57) ABSTRACT

A promotional form is provided which includes a detachable element received within the surrounding margin of a base sheet, the base sheet being folded and sealed around one side of the detachable element to initially conceal a message, question or other indicia hidden until the detachable element is at least partially removed. The promotional form may include a plurality of detachable elements having correlated indicia printed on an exposed side and either on the concealed side of the element or in a portion of the opposing form section in registry with the detachable element. A game or educational piece may be inexpensively provided by correlating different indicia messages corresponding to respective detachable elements, so that in response to an initial query or instruction, a plurality of possible results may be revealed, leading in turn to an outcome revealed by removal of a further detachable element. Tampering with the form is revealed when multiple detachable elements corresponding to alternate results are removed, or the adhesive bonding the facing form sections is disturbed.

15 Claims, 4 Drawing Sheets

U.S. PATENT DOCUMENTS 4,097,068 A 6/1978 Garnier, Sr.
5,020,829 A * 6/1991 Shibahara et al. ..... 283/62
5,029,901 A * 7/1991 Dotson et al. ..... 462/55
5,076,613 A 12/1991 Kovacs
5,125,689 A 6/1992 Heninger
5,174,609 A 12/1992 Tucker
5,253,899 A 10/1993 Greenwood
5,289,972 A * 3/1994 Sauerwine et al. ..... 229/303
5,376,048 A * 12/1994 Whiteside ..... 462/6
5,618,112 A 4/1997 Lovell
5,667,247 A * 9/1997 Ramsburg et al. ..... 283/61
5,716,688 A 2/1998 Burke et al.
5,893,512 A * 4/1999 Diedrich ..... 229/92.1
5,941,451 A * 8/1999 Dexter ..... 229/92.1
6,092,843 A * 7/2000 Peterson et al. ..... 283/116
6,131,802 A * 10/2000 Lombardo ..... 229/92.1
6,214,153 B1 * 4/2001 Chess ..... 156/253
6,322,106 B1 * 11/2001 Mehta et al. ..... 281/2
6,322,655 B1 * 11/2001 Casagrande ..... 156/257
6,349,829 B1 * 2/2002 Matheis et al. ..... 206/449
6,406,586 B1 * 6/2002 Rodriguez ..... 156/289
6,422,938 B1 * 7/2002 Steitz ..... 462/18
6,431,437 B1 * 8/2002 Lombardo et al. ..... 229/305
6,474,694 B1 * 11/2002 Emmert et al. ..... 283/56
2003/0049403 A1 * 3/2003 Crum et al. ..... 428/42.3

* cited by examiner

PROMOTIONAL FORM WITH DETACHABLE ELEMENT

BACKGROUND OF THE INVENTION

1. Field of the Invention

This invention broadly concerns a form useful as a promotional or gaming device which includes a detachable element which is initially integral with the form. The form is constructed and printed to be tamper-evident and folded to initially obscure a hidden message which is revealed when the element is detached.

2. Description of the Prior Art

Various promotional and gaming pieces have been developed which employ a paper backing and a hidden message. For example, game pieces have been developed which are adhesively attached to beverage cups and food containers and which may be removed and an adhesive cover pulled away to reveal the contents, as well as paper tickets and the like which have an opaque coating which may be removed by scratching with a coin or the like. U.S. Pat. No. 3,900,219 shows a lottery ticket or game piece which includes a base sheet on which information is printed and a two-ply cover which is adhesively adhered to the base sheet. Tearing away the intermediate sheet of the cover also tears the cover sheet to reveal a number printed on the front of the base sheet.

The promotional and gaming pieces of the prior art require specialized equipment to print, seal, apply coatings and adhesive, and apply to a substrate surface. There has developed a need for a promotional item made primarily of a paper material and which may be readily printed. There has developed a further need for a promotional item which may be printed on-demand and remains tamper-evident.

SUMMARY OF THE INVENTION

These objects have largely been met by the promotional form with detachable element of the present invention. That is to say, the promotional form of the present invention is readily printable in a conventional desktop printer such as a laser printer or ink-jet printer, can be printed on-demand, and includes a detachable element which includes tamper-evident features to indicate whether information intended to be hidden until removal of the detachable element has been prematurely revealed. Furthermore, the promotional form hereof may include either one or a plurality of detachable elements, so that the information which is initially hidden is revealed contingent upon which of the elements is removed.

Broadly speaking, the present invention includes a base sheet having a first side and a second side and at least one transverse fold line dividing the base sheet into at least first and second sections. A line of weakness is provided in at least a part of one of the first and second sections to define a detachable element. In preferred embodiments, a transparent film window is adhered to the second side in covering relationship to the detachable element and preferably surrounding relationship to the line of weakness. Indicia is printed on the first side of the base sheet and on at least a portion of the second side of the base sheet. The base sheet is folded along the one transverse fold line whereby the first side of each of the first and second sections are opposed and then adhesively connected to one another. When so folded, the first side of the detachable element is exposed, whereas the second side of the indicia is hidden, as is the portion of the other of the first and second sections opposite the detachable element. Preferably, indicia in the form of an instruction, question, answer, prize information, or other information is revealed when the detachable element is removed, but is hidden from viewing prior to such detachment; tampering to reveal such indicia being evident in the event that the adhesion between the first and second sections is broken or when more than one of a plurality of detachable elements is removed.

The base sheet can be provided with a plurality of transverse fold lines to create third, fourth or additional sections. The added fold lines permit segregation of different elements or portions of the promotional form to be detached along the fold lines. Indicia printed on the base sheet can be arranged so that a question, answer or prize information is sequentially revealed, or revealed on either the detachable element or on the portion of the base sheet opposing the detachable element and visible upon removal of the detachable element. The indicia may be preprinted indicia, meaning tha that the indicia is printed at the time the form is die cut for the detachable element and mass produced, and may also include variable indicia, which as used herein means indicia printed on demand from information stored in a computer database which is particularlized to a single one of the forms, such as the name and address of an individual recipient and a question or award printed to be particular to an individual based on computer selection from either random number generation or criteria to be applied from information stored in the computer database. In particularly preferred embodiments, the transparent film window may be provided as a pen writable film whereby the issuer could readily write on the film to indicate receipt or validation of any prize awarded. Further, in particularly preferred embodiments the film window may be provided having two laminated plys wherein one ply remains with the detachable element after removal. The base sheet may be imprinted with indicia to provide an initial question, a plurality of possible answers, and a prize notification if the correct answer is selected. Such an arrangement is especially suited for gaming pieces and in particular educational games. Masking indicia may be printed on the first or second side of the sections as appropriate in order to provide additional resistance to premature discovery of the hidden indicia.

It is particularly advantageous if the adhesive used for bonding the first section to the second section is employs a co-operative cohesive which bonds when the cohesive is mated in facing relationship to itself under the application of pressure. The use of cohesive is advantageous in permitting ready handling of the base sheet without premature adhesion while providing good bonding and evidence of tampering. Furthermore, the use of a cohesive to bond the first and second sections permits the use of conventional folder-printer units to process the forms on demand. Advantageously, the cohesive can be applied in various patterns for security to surround the detachable element, or to provide pockets defined by the connected sections.

The form hereof is remarkably easy to print, seal and use. The base sheet may be preprinted with information such as the name of the sponsor, promotional information, addresses and telephone numbers. In fact, all of the information can be preprinted. The film element may be adhered and the line of weakness provided by scoring, die cutting or similar means. When the film element is a laminate of two plies, the die cutting may extend into one but not the other ply of the film element whereby one ply of the film adheres to the detachable element upon removal while the other remains with the surrounding portion of the base sheet. The base sheet is then folded into sections when folded along the transverse fold line or lines, and then may be adhered so that the second side of the detachable element and the portion of the other section facing it is hidden from view.

However, it is often desired that the promotional form include customized or variable information. For example, it may be desired that a prize be awarded on a random generation basis determined by a computer random generator having access to a plurality of different prizes in its database which prize is awardable when printed onto the form. It may also be desirable that a promotional award be dependent upon the identity of the recipient, whereby certain preferred customers obtain a prize of greater value than others. In this instance, a common base sheet may be provided having common preprinted information and then, at the time of issuance, be printed with the variable indicia by a printer and introduced into a folder/sealer and then issued to the customer. The form emerges from the printer and is introduced into a folder/sealer so that the form can be delivered in a finished condition after local printing and finishing. In the event the form is torn or the bond is separated, the prize may be deemed void.

Thus, an inexpensive, tamper-evident and easy-to-use promotional piece is provided by the present invention. Those skilled in the art will appreciate the advantages of the present invention with reference to the detailed description and drawings which follow, wherein:

DESCRIPTION OF THE PREFERRED EMBODIMENT

Figure 1:
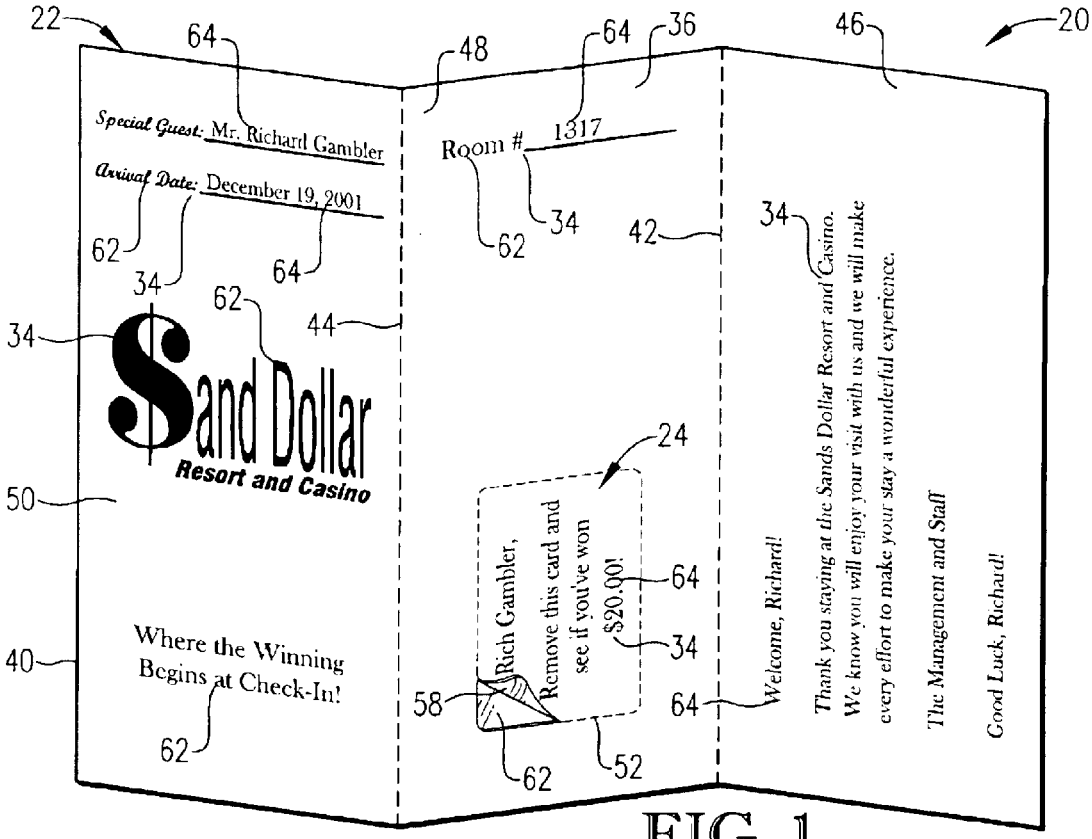
FIG. 1 is a front elevational view of a first embodiment of my promotional form showing both preprinted and customized information printed on the first side of the base sheet.

Referring now to the drawings, a promotional form 20 in accordance with the present invention broadly includes a base sheet 22 of paper or other material adapted for retaining printing thereon and having a detachable element 24 unitary with the base sheet 22 prior to detachment. The form 20 is provided with adhesive 26 provided in a pattern 28 on the base sheet. A film window 30 is adhered by a permanent adhesive 32 to one side of the promotional form in covering relationship to the detachable element. Indicia 34 is printed on the base sheet 22 in particular positions as will be described hereinafter prior to folding of the promotional form into the final configuration thereof shown in FIG. 5.

In greater detail, the base sheet 22 has a first side 36 and a second side 38, a surrounding margin 40, and at least one and preferably a plurality of transverse fold lines 42, 44 which may be provided by perforations or other lines of weakness. The transverse fold lines (which may include perforation lines, as shown) divide the base sheet 22 into respective first section 46, second section 48 and third section 50, whereby the fold lines may facilitate separation of the sections 46,48 and/or 50 from one another if desired.

The detachable element 24 is defined by a line of weakness 52 which is preferably entirely discrete from and interior of the surrounding margin 40. The line of weakness 52 may be provided by die-cutting and preferably is a score line or a perforation line so that premature removal of the detachable element 24 from the surrounding remainder of the base sheet 22 may be readily detected.

Figure 2:
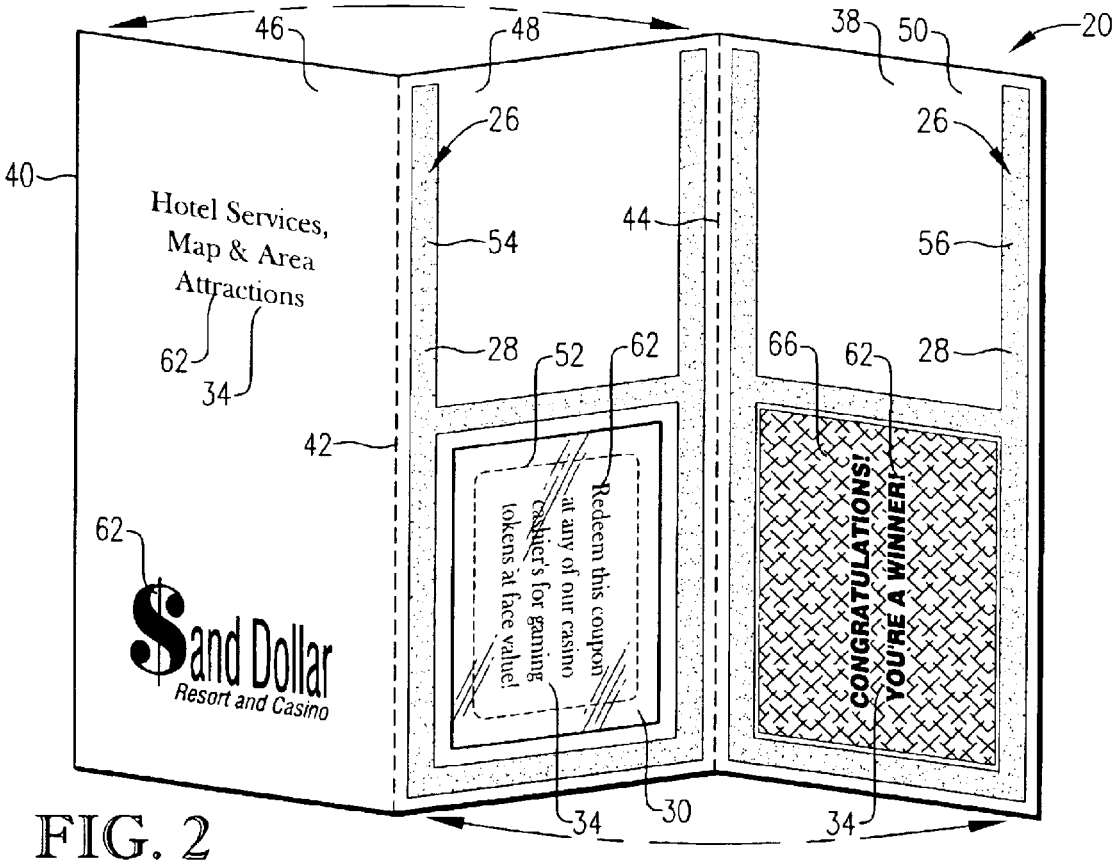
FIG. 2 is a rear elevational view thereof, showing the adhesive pattern and the arrows indicating the mating edges after folding of the form along the fold lines.
Figure 3:
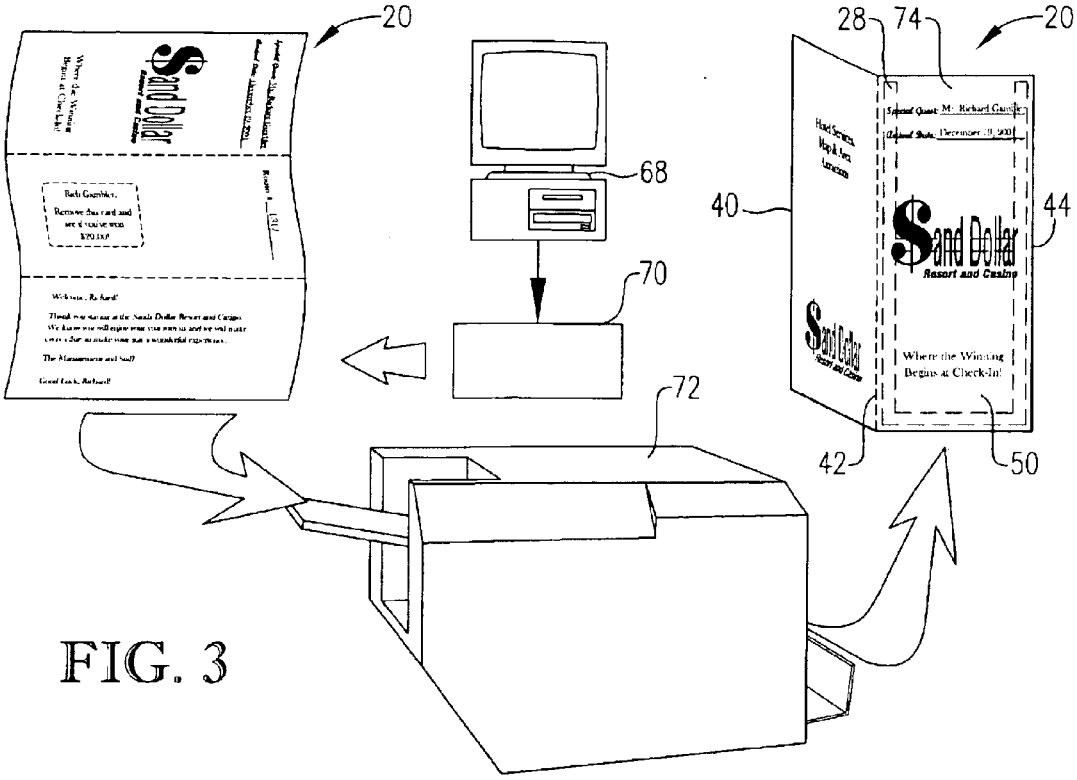
FIG. 3 is a diagrammatic view showing the first embodiment of the promotional form entering a folder/sealer machine and emerging therefrom in a finished condition.

The adhesive 26 is applied in pattern 28 which preferably is positioned in surrounding relationship to the detachable element as shown in FIG. 2. As used herein, the adhesive 26 may be any type of adhesive including thermoplastic adhesive and remoistenable adhesive. However, the preferred adhesive 26 for use in the pattern 28 is a contact adhesive, also known as a co-hesive, which bonds when mated to a surface provided with the same or a compatible contact adhesive, usually under at least nominal pressure. One such contact adhesive or cohesive is described in U.S. Pat. No. 4,918,128, the disclosure of which is incorporated herein by reference. Examples of the use of contact adhesive in folded and sealed paper articles are set forth and described in U.S. Pat. Nos. 4,918,128, 4,928,875, 5,201,464 5,253,798, 5,314, 110, and 5,941,451, the disclosures of which are incorporated herein by reference. As shown in FIG. 2, the pattern 28 includes two pattern segments 54 and 56, each on a respective section of the base sheet and on the same side (in this case the second side 38) of the base sheet, each of the pattern segments 54 and 56 being a mirror image of the other. The pattern segments 54 and 56 as shown in FIG. 2 are particularly configured to both provide a square box framing the detachable element 24 and the film window 30 and having upright legs extending in substantially spaced-apart parallel orientation so as to provide a pocket between respective form sections 48 and 50 when the base sheet 22 is folded along fold line 44 and the pattern segments 54 and 56 are in registry and pressed together.

Figure 5:
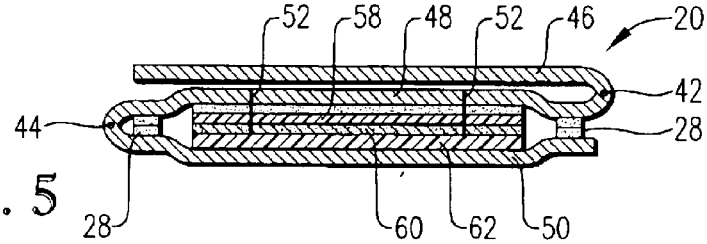
FIG. 5 is an enlarged vertical cross-sectional view of the first embodiment of the form wherein the thicknesses are exaggerated for illustrative purposes and showing the die cut forming the detachable element and the laminated film window.

The window 30 is preferably included with the form 20 to provide a more finished appearance and to provide support for the detachable element 24. The window is preferably provided of synthetic resin transparent film, which may be a pen writable film which accepts and retains ink. Most preferably, the film is provided as a laminate as shown in FIG. 2 having a top ply 58 which lies adjacent the detachable element 24, a release coating 60, and a bottom ply 62. A thin layer of permanent adhesive 32 bonds the top ply 58 to both the detachable element 24 as well as the surrounding portion of the section from which the detachable element is provided. As shown in FIG. 5, the line of weakness 52 preferably extends through the top ply 58 and the layer of release coating 60 but not through the bottom ply 62.

The indicia 34 as shown in FIGS. 1, 2, 3 and 4 illustrate the use of the form as a promotional piece for a hotel and casino, but it is to be understood that such printing is by way of example only. The indicia 34 includes preprinted indicia 62 which may be provided at the point of manufacture prior to application of variable indicia 64 which may be provided at the time of issuance when the form 20 is folded and sealed. Thus, in the embodiment of the form 20 shown in FIGS. 1–5, the issuer's name and address, blank lines for receiving guest's name, arrival date and room number, advertising slogans, map information, instructions for redemption positioned on the detachable element 24 facing the window 30, and winner's congratulation may be preprinted indicia 62 which is common to all forms 20 retained by the issuer. In addition, the preprinted indicia may include masking indicia 66 printed However, the issuer may also choose to customize the form 20 with variable indicia. Such variable indicia may be selected at random, or by selecting the indicia to be printed on the form 20 for particular recipients who are, for example, customer's deserving of varying levels of incentives. In the example shown in FIGS. 1–5, entry of the guest's name into the issuer's computer 68 may have resulted in the computer database identifying Mr. Richard Gambler as having no previous gambling record or only a modest gambling record with the casino and thus entitled to a moderate incentive as a part of the variable indicia 64—here a $20 prize. The computer 68 is connected, and thus communicates the variable information, to a suitable printer 70. One typical printer 70 useful in this application would be, for example, a Hewlett Packard 4100 available from Hewlett Packard, Inc. of Boise, Id. However, if the computer database identified Mr. Richard Gambler as someone who routinely gambled large amounts of money, software within the computer 68 might instruct the printer 70 to print a prize figure substantially larger than $20 based on preselected criteria. It may be appreciated that similar criteria may be applied to provide preferential treatment to frequent customers or the computer 68 may invoke a random number generator to instruct the printer 70 to print larger or smaller prize figures as a part of the variable indicia 64 at random.

Figure 4:
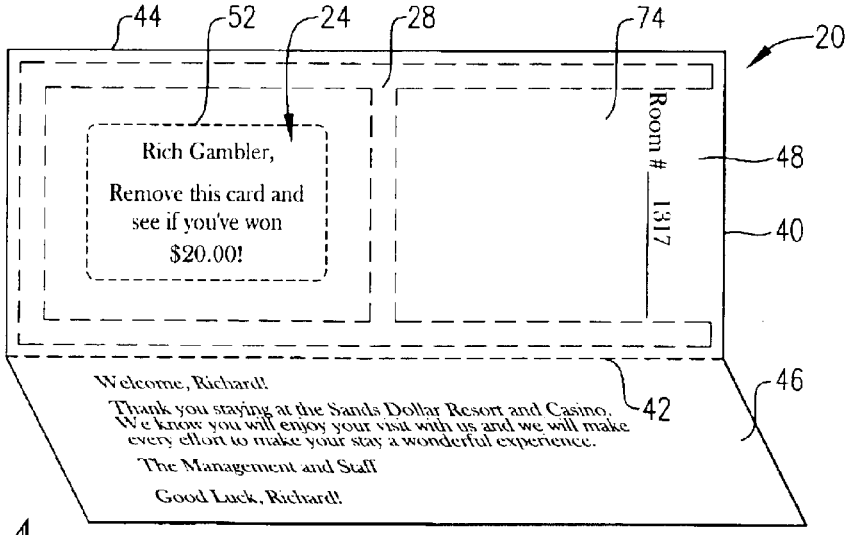
FIG. 4 is a perspective view showing the first embodiment of the form in a finished condition as presented to the recipient, with the bonded areas corresponding to the cohesive which are present on the opposite side of the form shown in dashed lines.

In use, after the variable indicia 64 is printed by printer 70, the issuer folds the form along the fold lines 42, 44 so that the pattern segments 54 and 56 are pressed together and the sections 48 and 50 bond together along the pattern. While this may be done manually, for automated and volume production of the form, the issuer introduces the form into a folder/sealer 72. Although many folder/sealers are useful in connection with the present invention depending on the type and nature of adhesive 26 used, one folder/sealer useful with low-pressure contact adhesives is a Formax 2052 available from Bescorp, Inc. of New Hampshire. The form 20 then includes a pocket 74 formed between the sections 48 and 50 and defined by the adhesive pattern 28 as shown in FIG. 4, the pocket being useful for receiving a hotel key card or the like.

When the recipient receives the form 20 from the issuer, he or she is advised of the possibility of winning a prize by removing the detachable element 24. It may be appreciated that the creation of a gaming atmosphere by immediately providing the guest at a hotel/casino with a possibility of winning is a desirable promotional strategy to promote the gaming industry. Moreover, this atmosphere is enhanced when the form 20 is used as a promotional item wherein all guests receive some prize incentive printed as part of the variable indicia 64. It should be noted that the indicia on the second side of the form 20 is correlated in meaning to the indicia appearing on the first side of the form. The recipient separates the detachable element along the line of weakening and removes the detachable element to see the congratulatory message and to read the redemption instructions. The use of a two-ply laminate as window thirty permits the top ply to remain with the detachable element and the issuer may validate or verify redemption of the prize by writing on the pen-writable film of the window 30.

Figure 6:
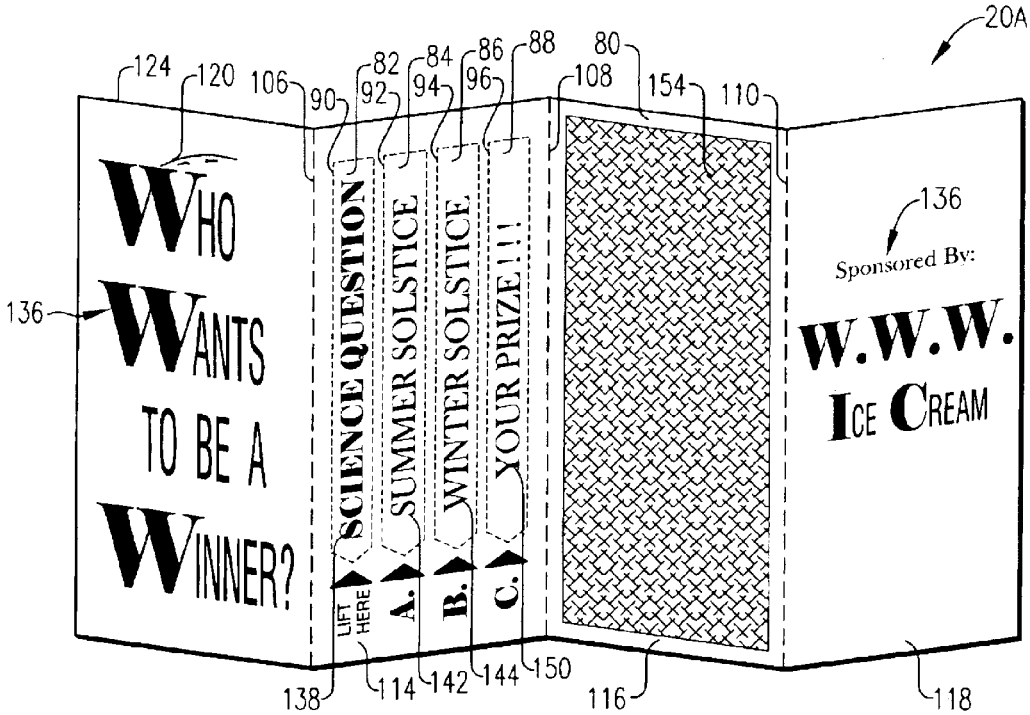
FIG. 6 is a front elevational view of a second embodiment of my promotional form showing a plurality of fold lines dividing the form into four sections and lines of weakness forming four adjacent detachable elements.
Figure 7:
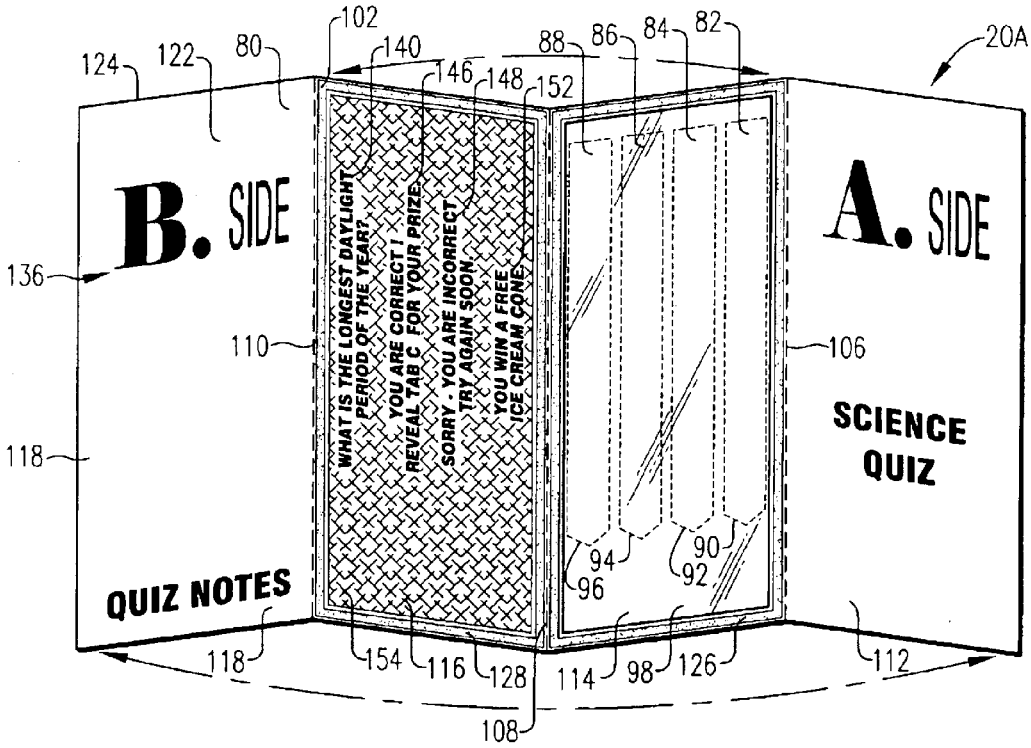
FIG. 7 is a rear elevational view of the embodiment of the form shown in FIG. 6, showing four discrete indicia segments corresponding to respective detachable elements and printed on one of the sections which, when the form is folded along the fold lines so that the edges of the respective sections mate as indicated by the arrows, align in registry with their respective detachable elements.
Figure 8:
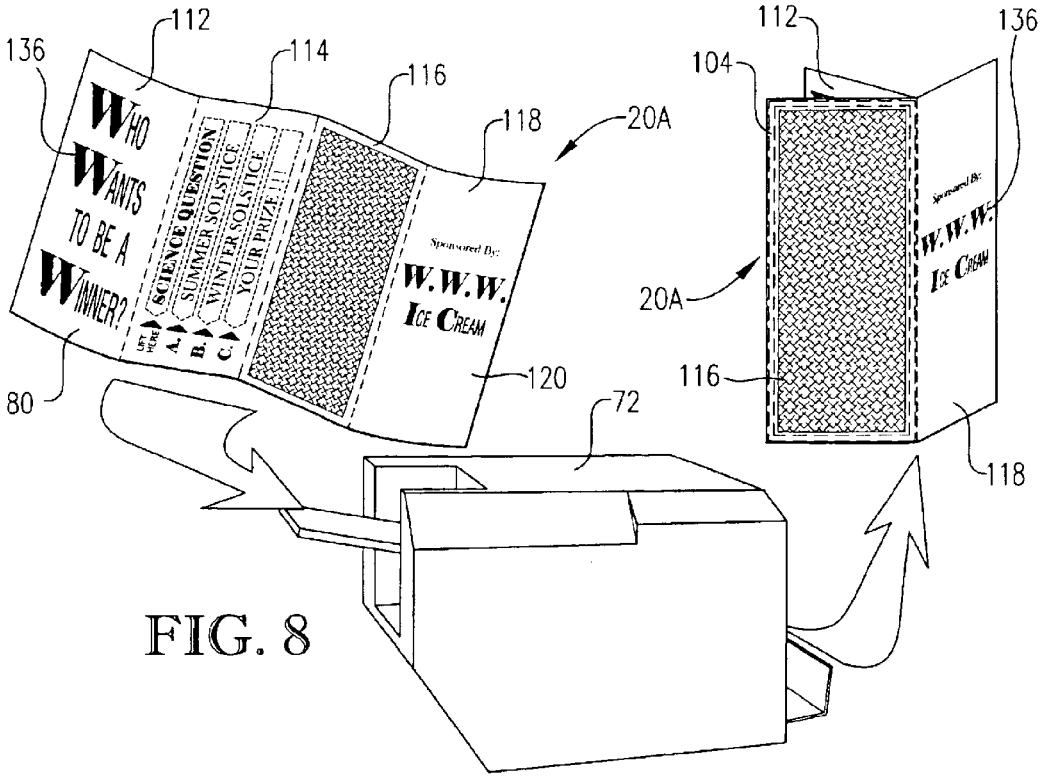
FIG. 8 is a diagrammatic view showing the promotional form of FIG. 6 entering a folder/sealer machine and in a finished condition leaving the folder/sealer machine.
Figure 9:
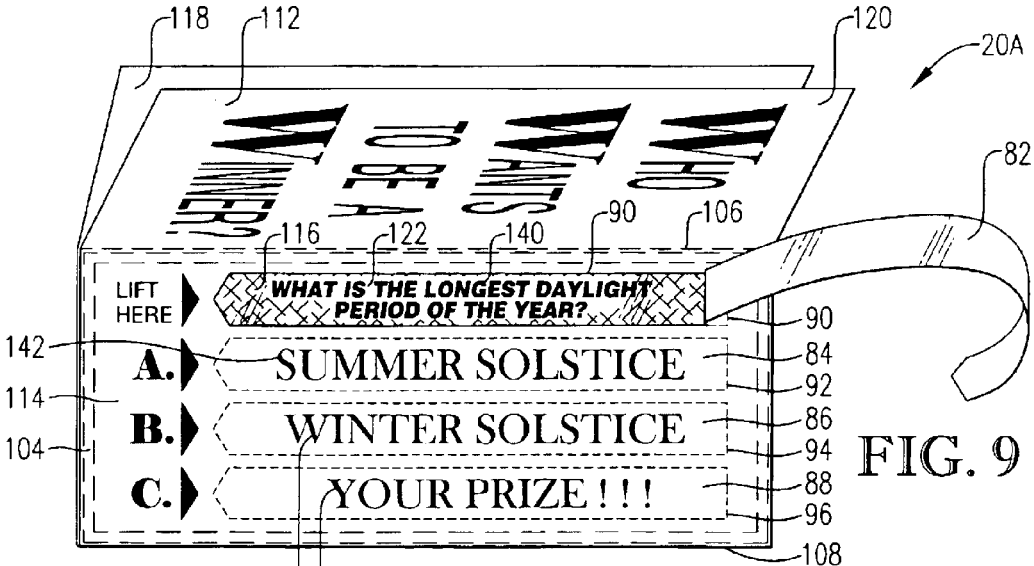
FIG. 9 is a perspective view of the second embodiment of the form shown in FIG. 6 in a finished condition with a first detachable element partially removed to reveal an indicia segment corresponding thereto.

While the form 20 shown in FIGS. 1–5 is particularly suitable for use as a promotional piece, a second embodiment of the form 20A as shown in FIGS. 6–10 provides additional possibilities for use as an educational or gaming piece. Form 20A broadly includes a base sheet 80 of paper or other printable substrate material, which base sheet 80 includes a plurality of detachable elements 82, 84, 86 and 88 integrally formed with the base sheet 80. The detachable elements are defined by corresponding lines of weakness 90, 92, 94 and 96 which in the embodiment of the form 20A shown herein, lie in adjacency or at least close proximity. It may be appreciated that the number of detachable elements is not limited to four in order to provide greater variety, chance and options to the form 20A. A window 98 may be adhered by a permanent adhesive 100 to the base sheet in covering relationship to the detachable elements 82, 84, 86 and 88 as shown in FIG. 7. In addition, adhesive 102 is provided in a pattern 104 which preferably surrounds the detachable elements on at least one side of the base sheet 80 as shown in FIG. 7.

The form 20A shares many features in common with form 20. For example, the base sheet 80 includes a plurality of transverse fold lines 106, 108 and 110 which divide the base sheet 80 into form sections 112, 114, 116 and 118. The base sheet 80 has a first side 120 and a second side 122 and a surrounding margin 124. The fold lines 106, 108 and 110 together with the surrounding margin 124 define the edges of the respective form sections 112, 114, 116 and 118, the edges of the sections mating when folded as indicated by the arrows in FIG. 7 so that the form assumes the configuration shown in FIG. 10.

The detachable elements 82, 84, 86 and 88 are shown as positioned on the same form section 114, although it may be appreciated that the detachable elements could be positioned on different form sections. As shown in FIGS. 6–10, the second side 122 of the form section 114 is provided with a pattern segment 126 of adhesive 102, which is preferably a contact adhesive, which substantially surrounds all of the detachable elements 82, 84, 86 and 88. When a contact adhesive 102 is used, the second side of adjacent form section 116 is also provided with a pattern segment 128 of adhesive 102, pattern segment 128 being a mirror image of pattern segment 126 whereby, when base sheet 80 is folded along fold line 108, the pattern segment 126 on form section 114 lies in registry and mates with pattern segment 128 of form section 116 to substantially surround and seal the form 20A around the edges of the second sides of both form section 114 and 116 shown in FIGS. 8, 9 and 10. If the adhesive pattern is broken or disturbed along a portion thereof, tampering is evident.

Figure 10:
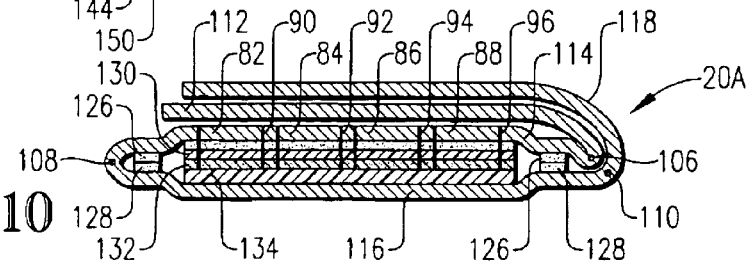
FIG. 10 is an enlarged vertical cross-sectional view of the second embodiment of the form wherein the thicknesses are exaggerated for illustrative purposes and showing the die cuts forming the detachable elements and the laminated film window.

The window 98 of form 20A is similar to that of form 20 in that it is optional but included in the preferred embodiment. When window 98 is included, it is of a material and construction as described with regard to window 30 in that it is preferably a pen writable, two ply, transparent synthetic resin laminate having adhesive 100 bonding the top ply 130 to the second side of the form section 114 and also to each of the detachable elements. A layer of release coating 132 is located intermediate the top ply 130 and a bottom ply 134. Lines of weakness 90, 92, 94 and 96, which may be discrete as shown or contiguous, preferably extend through the base sheet 80 and the top ply 130 as shown in FIG. 10 so that the top ply 130 remains with any of the detachable elements which have been torn away.

The form 20A is also provided with indicia 136 printed on each side thereof. The indicia may be preprinted to be the same on each form 20A or different for each form 20A in a set of such forms, or may be printed on demand. As shown in FIGS. 6 and 7, the form 20A is especially useful as an educational or promotional piece when the indicia printed in correspondence to each detachable element is interrelated. The indicia 136 may be printed on both the first side 120 and the second side 122 of the base sheet 80, and arranged with regard to the detachable elements so that the indicia 136 appearing on or adjacent the first side of the detachable elements is correlated in meaning to the indicia printed on the second side of the form section 116 which is in registry with the corresponding detachable element and revealed for viewing when the covering detachable element is at least partially torn away. In preferred embodiments, the indicia 136 printed on or adjacent the first side 120 of detachable element 82 includes question or selection identifying indicia 138. Question or selection indicia 140 is printed on second side 122 of form section 116 in registry with the detachable element 82 after folding and sealing and presents a query or selection instruction to proceed to a next sequential step, so as to be viewable upon complete or at least partial removal of the detachable element 82. Alternatively, the question or selection indicia 140 could be printed on the second side 122 of the detachable element 82. Preferably, discrete and alternate first and second choice indicia 142 and 144 is respectively printed on or adjacent the first side 120 of each of a plurality of the detachable elements, such as shown with regard to detachable elements 84 and 86. As shown, first and second choice indicia 142 and 144 are answer indicia which correspond to the question or selection indicia 140 as plausible choices. Result indicia 146 is printed on the second side 122 of form section 116 in registry with the detachable element 84 after form 20A is folded and sealed, while result indicia 148 is printed on the second side 122 of form section 116 in registry with the detachable element 86 after form 20A is folded and sealed. First result indicia 146 corresponds to first choice indicia 142 and detachable element 82, while second result indicia 148 corresponds to second choice indicia 144, first result indicia 146 and second result indicia 148 desirably being quite different and distinguishable and at least one of the result indicia identifying a correct answer or more favorable outcome while a second or other result indicia identify that the choice indicia selected was incorrect and indicate a corrective or less favorable outcome. Detachable element 86 is provided with indicia such as outcome indicator indicia 150 printed on or adjacent the first side 120 of the detachable element 86. Outcome indicia 152 is printed on the second side of form section 116 in registry with the detachable element 88 so as to be viewable only after partial or complete removal of the detachable element 88. Outcome indicia 152 is preferably conceptionally sequentially related to the more favorable one of first result and second result indicia, so that tearing of the detachable element 84 or 86 corresponding to the more favorable outcome, such as a correct answer results in the user being instructed to tear away the detachable element 88 to reveal a favorable outcome indicia 152. Thus, in the preferred embodiment of the form 20A, the user is presented with a question revealed by tearing away of detachable element 82, sequentially invited to select one of a plurality of choices—only one of which is correct—by tearing away only one of a plurality of detachable elements 84 and 86, and, if the result indicia is favorable, invited by the result indicia 146 or 148 which corresponds to the preferred or correct choice to tear away detachable element 88 which reveals a favorable outcome such as a congratulatory note, a prize indication redeemable for value, or some other benefit. Masking indicia 154 may be printed on either the first side 120, the second side 122, or both the first and second side of the form 20A, such as on form section 116 as shown in the drawings, to help mask the various outcomes from premature disclosure.

The form 20A is produced similar to form 20, in that it is initially printed either by preprinting or on demand by variable printing, then folded and sealed either manually or by a conventional folder/sealer 72. As completed, the form 20A assumes a folded configuration as shown in FIG. 10.

Both forms 20 and 20A afford tamper evident features which are available using conventional, on-demand desktop printing and sealing equipment which are normally available only through greatly more sophisticated and expensive techniques and equipment. Whether preprinted or printed on demand, the forms 20 and 20A can be immediately folded and sealed. When contact adhesive is used, separation of the adhesive in the mated the form sections reveals tampering. Removal of any part of the detachable elements is immediately visible, so that if multiple detachable elements corresponding to more than one choice indicia are even partially torn away, the form may be voided. Because conventional paper can be used for the form, the use of the window with the laminated plys, one of which separates with each detachable element, aids in deterring counterfeiting. The use of pen writable laminate helps to ensure that prizes which are awarded are not improperly duplicated when the issuer signs the laminate to show that the prize corresponding to that detachable element has been awarded. The use of masking indicia helps to deter interrogation of the form by light to reveal which of the forms contains more favorable outcomes so as to deter improper preferential pre-selection by the issuer's employees. When variable information is printed locally by a desktop printer, the computer database may randomly generate outcomes and vary the queries and instructions if desired to create a form which is more dynamic in use, or will match awards to recipients by criteria determined by the issuer. The computer will retain data corresponding to the variably printed information so as to reveal which awards are issued to which recipients, thus providing a further check on improper issuance of forms having improper preferred outcomes.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of his invention as pertains to any apparatus not materially departing from but outside the literal scope of the invention as set out in the following claims.

What is claimed is:

1. A form comprising:

a base sheet having a first side and a second side and a surrounding margin, said base sheet further including at least one transverse fold line dividing said base sheet into at least first and second sections;

a line of weakness in one of said first and second sections of said base sheet defining an element which is initially integral with the base sheet but may be at least partially separated from the base sheet along said line of weakness;

a pattern of adhesive positioned on the second side of at least one of said first and second sections, said base sheet being folded along said one transverse fold line whereby said the first and second sections arc adhesively bonded with said pattern substantially surrounding said line of weakness on said second side of said base sheet; and first indicia printed on one of the second side of at least one of said detachable element and the second side of other of said first and second sections opposite and in registry with the detachable element, whereby said first indicia is initially hidden from direct viewing after the adhesive bonding of said first and second sides but is directly viewable upon at least partial separation of said detachable element from said base sheet.

wherein said line of weakness is positioned on said base sheet inside of the surrounding margin so as to be discrete therefrom, wherein said pattern of adhesive bonds said first and second sections to present a pocket distinct from a portion of the pattern surrounding said detachable element.

2. A form comprising:

a base sheet having a first side and a second side and a surrounding margin, said base sheet further including at least transverse fold line dividing said base sheet into at least first and second sections;

a line of weakness in one of said first and second sections of said base sheet defining an element which is initially integral with the base sheet but may be at least partially separated from the base sheet along said line of weakness;

a pattern of adhesive positioned on the second side of at least one of said first and second sections, said base sheet being folded along said one transverse fold line whereby said the first and second sections are adhesively bonded with said pattern substantially surrounding said line of weakness on said second side of said base sheet;

first indicia printed on at least one of the second side of said detachable element and the second side of the section opposite and in registry with the detachable element, whereby said first indicia is initially hidden from direct viewing after the adhesive bonding of said first and second sections but is directly viewable upon at least partial separation of said detachable element from said base sheet, said detachable element being accessible from said first side so as to be detachable when said first and second sections are adhesively bonded, wherein said line of weakness is positioned on said base sheet inside of the surrounding margin so as to be discrete therefrom; and a transparent film window adhesively coupled to said base sheet on said second side in covering relationship to said detachable element.

3. A form as set forth in claim 2, wherein said window is provided of a pen writable synthetic resin material.

4. A form as set forth in claim 2, wherein said window is provided of a laminate having a top ply adjacent said detachable element and base sheet and a bottom ply.

5. A form as set forth in claim 2, including second indicia printed on said first side of said base sheet interior to said detachable element and correlated to said first indicia.

6. A form as set forth in claim 4, wherein said line of weakness in said base sheet further extends into said top ply, whereby upon separation of said detachable element along said line of weakness, said top ply positioned in registry with said detachable element is removed therewith.

7. A form as set forth in claim 6, wherein upon separation of said detachable element, said bottom ply remains with said base sheet.

8. A form comprising:

a base sheet having a first side and a second side and a surrounding margin, said base sheet further including at least one transverse fold line dividing said base sheet into at least first and second sections;

a line of weakness in one of said first and second sections of said base sheet defining an element which is initially integral with the base sheet but may be at least partially separated from the base sheet along said line of weakness;

a pattern of adhesive positioned on the second side of at least one of said first and second sections, said base sheet being folded along said one transverse fold line whereby said the first and second sections are adhesively bonded with said pattern substantially surrounding said line of weakness on said second side of said base sheet;

first indicia printed on at least one of the second side of said detachable element and the second side of the section opposite and in registry with the detachable element, whereby said first indicia is initially hidden from direct viewing after the adhesive bonding of said first and second sections but is directly viewable upon at least partial separation of said detachable element from said base sheet, said detachable element being accessible from said first side so as to be detachable when said first and second sections are adhesively bonded;

second indicia printed on said first side of said base sheet interior to said detachable element and correlated to said first indicia; and masking indicia printed on said second side of the other of said first and second sections for inhibiting viewing of said first indicia prior to at least partial detachment of said detachable element.

9. A form as set forth in claim 8, wherein said line of weakness is positioned on said base sheet inside of the surrounding margin so as to be discrete therefrom.

10. A form comprising:

a base sheet having a first side and a second side and a surrounding margin, said base sheet further including at least one transverse fold line dividing said base sheet into at least first and second sections;

a line of weakness in one of said first and second sections of said base sheet defining an element which is initially integral with the base sheet but may be at least partially separated from the base sheet along said line of weakness;

a pattern of adhesive positioned on the second side of at least one of said first and second sections, said base sheet being folded along said one transverse fold line whereby said the first and second sections are adhesively bonded with said pattern substantially surrounding said line of weakness on said second side of said base sheet; and first indicia printed on at least one of the second side of said detachable element and the second side of the section opposite and in registry with the detachable element, whereby said first indicia is initially hidden from direct viewing after the adhesive bonding of said first and second sections but is directly viewable upon at least partial separation of said detachable element from said base sheet, said detachable element being accessible from said first side so as to be detachable when said first and second sections are adhesively bonded, said base sheet including a plurality of detachable elements unitary therewith, each said detachable elements defined by a respective line of weakness in said base sheet, said first indicia including respective and discrete indicia printed on one of the second side of at each of said plurality of detachable elements and the second side of other of said first and second sections opposite and in registry with each of the plurality of detachable elements, whereby each respective and discrete indicia of said first indicia is initially hidden from direct viewing after the adhesive bonding of said first and second sides but is directly viewable upon at least partial separation of each respective one of said detachable elements from said base sheet.

11. A form as set forth in claim 10, including a transparent film window adhesively coupled to said second side of said base sheet in covering relationship to said plurality of detachable elements.

12. A form as set forth in claim 10, said first indicia including respectively at least query or instruction indicia corresponding to a first one of said detachable elements, a plurality of separate and discrete result indicia correlated to said query or instruction indicia and corresponding to respective second and third detachable elements, and at least one outcomes indicia correlated to one of said result indicia and corresponding to a respective forth detachable element.

13. A form as set forth in claim 11, said transparent film window being provided of a pen writable synthetic resin material.

14. A form as set forth in claim 13, wherein said window is provided of a laminate having a top ply adjacent each of said detachable elements and said base sheet and a bottom ply, wherein each of said lines of weakness in said base sheet further extends into said top ply, whereby upon separation of each respective one of said plurality of detachable elements along its respective line of weakness, said top ply positioned in registry with the respective detachable element is removed therewith and wherein upon separation of said detachable element, said bottom ply remains with said base sheet.

15. A form comprising:

a base sheet having a first side and a second side and a surrounding margin, said base sheet further including at least one transverse fold line dividing said base sheet into at least first and second sections;

a line of weakness in one of said first and second sections of said base sheet defining an element which is initially integral with the base sheet but may be at least partially separated from the base sheet along said line of weakness;

a pattern of adhesive positioned on the second side of at least one of said first and second sections, said base sheet being folded along said one transverse fold line whereby said the first and second sections are adhesively bonded with said pattern substantially surrounding said line of weakness on said second side of said base sheet; and first indicia printed on at least one of the second side of said detachable element and the second side of the section opposite and in registry with the detachable element, whereby said first indicia in initially hidden from direct viewing after the adhesive bonding of said first and second sections but is directly viewable upon at least partial separation of said detachable element from said base sheet, said detachable element being accessible from said first side so as to be detachable when said first and second sections are adhesively bonded, wherein said adhesive is a contact adhesive applied to each of said first and second sections in complemental mirror-image pattern segments, each of said pattern segments being bondable when mated to the other of said pattern segments.

* * * * *